US005762761A

United States Patent [19]

Kivimaa et al.

[11] Patent Number: 5,762,761

[45] Date of Patent: *Jun. 9, 1998

[54] PRESS SECTION OF A PAPER MACHINE EMPLOYING TWO SEPARATE PRESS NIPS

[75] Inventors: Juha Kivimaa, Muurame; Juhani Pajula, Jyväskylä, both of Finland

[73] Assignee: Valmet Corporation, Helsinki, Finland

[ * ] Notice: The term of this patent shall not extend beyond the expiration date of Pat. No. 5,650,049.

[21] Appl. No.: 763,016

[22] Filed: Dec. 11, 1996

Related U.S. Application Data

[63] Continuation of Ser. No. 491,621, Jun. 19, 1995, Pat. No. 5,650,049.

[30] Foreign Application Priority Data

Apr. 24, 1995 [FI] Finland ..... 951934

[51] Int. Cl.[6] ..... D21F 3/02

[52] U.S. Cl. ..... 162/360.2; 162/358.3; 162/359.1

[58] Field of Search ..... 162/358.3, 359.1, 162/360.2, 360.3

[56] References Cited

U.S. PATENT DOCUMENTS

| | | | |
|---|---|---|---|
| 3,268,390 | 8/1966 | Ely, Sr. | 162/360.2 |
| 4,483,745 | 11/1984 | Wicks et al. | 162/360.2 |
| 4,976,820 | 12/1990 | Laapotti | 162/360.3 |
| 4,988,410 | 1/1991 | Meinecke et al. | 162/360.1 |
| 5,178,732 | 1/1993 | Steiner et al. | 162/360.2 |
| 5,308,450 | 5/1994 | Braun et al. | 162/360.2 |
| 5,389,205 | 2/1995 | Pajula et al. | 162/205 |

FOREIGN PATENT DOCUMENTS

| | | |
|---|---|---|
| 0107606 | 5/1984 | European Pat. Off. . |
| 0509199 | 10/1991 | European Pat. Off. . |
| 0487483 | 5/1992 | European Pat. Off. . |
| 935501 | 12/1993 | Finland . |
| 3815278 | 11/1989 | Germany . |
| 9206340 | 9/1992 | Germany . |
| 4112355 | 10/1992 | Germany . |
| 9108339 | 6/1991 | WIPO . |
| 9516821 | 6/1995 | WIPO . |

*Primary Examiner*—Karen M. Hastings

*Attorney, Agent, or Firm*—Steinberg, Raskin & Davidson, P.C.

[57] ABSTRACT

A press section for a paper machine employing at least two press nips placed one after the other. Of these nips, at least the first nip is an extended nip or an extended roll nip. The last nip in the press section is placed on a level higher than the preceding nip. The first nip and/or, when more than two nips are employed, the nip that immediately precedes the last nip is/are provided with two press fabrics that receive water. The paper web is transferred on the lower fabric of the two press fabrics onto an upper fabric of the last nip. On the lower face of the upper fabric, the web is transferred into the last nip. After the web transfer point, the upper fabric of the last nip has a relatively short upwardly inclined run. After this, the upper fabric is turned and guided by the lower roll of the last nip over a considerable sector thereof. The last nip is placed after, or at the vicinity of, the uppermost point of the lower roll that forms the last nip. The point of transfer of the web onto the drying wire of the first group in the dryer section following after the press section is placed underneath the level of the last nip.

10 Claims, 7 Drawing Sheets

PRESS SECTION OF A PAPER MACHINE EMPLOYING TWO SEPARATE PRESS NIPS

This is a continuation of U.S. patent application Ser. No. 08/491,621 filed Jun. 19, 1995 now U.S. Pat. No. 5,650,049.

FIELD OF THE INVENTION

The present invention relates to a cress section of a paper machine employing at least two press nips placed one after the other in the running direction of a paper web. At least the first nip is an extended nip or an extended or normal roll nip and the last nip in the press section is placed on a level higher than at least the immediately preceding nip. The first nip and/or, when more than two nips are employed, the nip that precedes the last nip is/are provided with two press fabrics that receive water. The paper web is transferred on a lower one of the press fabrics onto an upper fabric of the last nip on whose lower face the web is transferred into the last nip.

BACKGROUND OF THE INVENTION

One of the most important quality requirements of all paper and board grades is uniformity of the structure both on the micro scale and on the macro scale. The structure of paper, in particular of printing paper, must also be symmetric. The good printing properties required from printing paper connote good smoothness, evenness, and certain absorption properties of both faces of the paper. The properties of paper, in particular the symmetry of density, is affected to a considerable extent by the operation of the press section of the paper machine, which operation has also a decisive significance for the uniformity of the profiles of the paper in the cross direction and in the machine direction.

Increased running speeds of paper machines create new problems to be solved, which problems are mostly related to the runnability of the machine. Currently, running speeds of paper machines are up to about 1500 meters per minute. At these running speeds, so-called closed press sections, which comprise a compact combination of press rolls arranged around a smooth-faced center roll, usually operate satisfactorily. As examples of such press sections, the assignee's Sym-Press II™ and Sym-Press O™ press sections should be mentioned.

From the point of view of energy economy, dewatering of a paper web taking place by pressing is preferable to dewatering taking place by evaporation. For this reason, attempts should be made to remove a maximum amount of water out of the paper web by pressing in order that the proportion of water to be removed by evaporation could be made as small as possible. However, increased running speeds of paper machines create new problems expressly for the dewatering taking place by pressing because the press impulses in roll presses (which occur in dewatering by pressing) cannot be increased sufficiently, above all because at high running speeds, the nip times remain inadequately short. On the other hand, the peak pressure of pressing cannot be increased beyond a certain limit without destruction of the structure of the web.

With increasing running speeds of paper machines, the problems of runnability of a paper machine are also manifested with further emphasis because a web with a high water content and low strength does not withstand an excessively high and sudden impulse of compression pressure or the dynamic forces produced by high speeds and changes in direction. Rather, web breaks and other disturbance of operation arise which result in standstills of the paper machine.

A further drawback of conventional prior art press sections is the need of suction energy of suction rolls, which are commonly used in such press sections, and the additional drawback of the level of noise arising from the suction rolls. Further, the suction rolls, with their perforated mantles, inside suction boxes and other suction systems, are expensive components that require repeated servicing.

With respect to the prior art related to the present invention, reference is made to the assignee's Finnish patent application Ser. No. 905798 (equivalent to EP publication 0 487 483 A1 and U.S. patent application Ser. No. 07/795,043, the specification of which is hereby incorporated by reference herein, as well as U.S. patent application Ser. No. 08/025,851, now U.S. Pat. No. 5,389,205, which is a continuation-in-part of the '043 application) which describes a method which comprises a combination of the following steps: transferring the paper web from a forming wire onto a wire in the dryer section while constantly on support of a fabric that receives water, a transfer fabric, or of any other, corresponding transfer face as a closed draw, preferably at a speed that is higher than about 25 m/s to about 30 m/s; dewatering the paper web by means of at least two successive press nips, of which nips at least one press nip is a so-called extended-nip zone, whose length in the machine direction is larger than about 100 mm, and the extended-nip zone is formed in connection with a mobile flexible press-band loop; and regulating and/or selecting the distribution of the compression pressure employed within the extended-nip press zone both in the cross direction of the web and in the machine direction so as to set or to control the different profiles of properties of the web. A device including elements for performing the above-mentioned steps is also described in the Finnish patent application.

It is a further important feature of the method and the device of FI 905798 that the paper web is not passed through the press section on only one press fabric. Rather, in order to guarantee an adequate dewatering capacity, an arrangement of fabrics is employed in which the web is transferred from the pick-up point on the first upper fabric through the first press zone, preferably an extended-nip zone, through which zone the first lower fabric runs, onto which the web is transferred after the nip zone. From the first lower fabric, the web is transferred onto the second upper fabric which carries the web into the second nip zone, which is a roll nip or preferably an extended-nip zone. After the second nip zone, the web is transferred onto the second lower fabric, which runs through the second nip zone and which carries the web on its upper face, as a closed draw, onto the drying wire or into the next, following nip zone.

With respect to the prior art closely related to the present invention, reference is made further to the assignee's Finnish patent application Ser. No. 935501, filed on Dec. 8, 1993 (equivalent to EP Pat. Appl. 94119255.1 and corresponding to U.S. patent application Ser. No. 08/332,861, the specification of which is hereby incorporated by reference herein). In that patent application, a press section is described in which a combination of the following characteristics has been considered inventive: the first nip in the press section is an extended-nip press having a press zone through which two opposite press fabrics that receive water are passed, so that in the first extended-nip press the dewatering takes place in two directions through both faces of the paper web; the upper press fabric in the extended-nip press is a pick-up fabric which carries the paper web from the forming wire on its lower face; at least two roll nips in the press section have been formed in connection with a smooth-faced center roll, which center roll is arranged at a level substantially higher than the level of the extended-nip press, and of which roll nips, in the first roll nip the press fabric consists of the pick-up fabric, and the second roll nip has a press fabric of its own that receives water; and, after the first extended-nip press, the running direction of the paper web has been turned at an angle a which is selected to be greater than or equal to about 45°.

OBJECTS AND SUMMARY OF THE INVENTION

It is an object of the present invention to further develop the prior art so that most of the drawbacks that have been mentioned above and that will be described later can be substantially avoided.

Another object of the present invention is to provide a press-section construction that is quite compact, especially in the machine direction. This is an important objective in particular in such modernizations of paper machines in which it is necessary to fit a new press section, which has a higher dewatering capacity and in which one or several extended nips are used, in the place occupied by an earlier press section consisting of roll nips (such as the assignee's SYM-PRESS II™).

It is a further object of the present invention to provide a press section in which, in a first nip in the running direction of a paper web, a relatively high press load can be employed, which contributes to an adequate dewatering capacity of the press section and to a sufficiently high dry solids content of the web. The latter factor is important because an increased dry solids content also increases the strength of the web and thereby also secures an undisturbed and reliable transfer of the web through the press section after the first nip.

It is another important object of the invention to provide a press section in which it is possible to employ steam boxes, infrared heaters or equivalent for heating the web in order to intensify the dewatering of the web.

Thus, it can be stated that the overall object of the present invention is further development of the prior art described above and to provide a compact and simple press section of a paper machine, which press section is provided with at least two separate presses and in which press section, a closed draw of the web is provided between a first nip and a second nip so that the runnability of the web is improved and that a draw difference need not be stretched into the web.

It is yet another object of the invention to provide a press section in which the first extended-nip zone dewaters the web efficiently and in the second extended-nip zone, partly because of an elevated temperature of the web, efficient dewatering is also achieved.

It is still another object of the invention to provide a press section in which, in the second nip, if necessary, it is possible to act upon the smoothness values of the web because the web tends to become coarse after the first extended nip. The compact and simple construction of the press section in accordance with the invention is associated with the object of providing a particularly low construction, in which the felt cycles are low and simple.

It is a further object of the invention to provide a press section in which it is possible to arrange an advantageous removal of broke by the force of gravity into a pulper or onto a broke conveyor placed below the press section.

It is still another object of the invention to provide such a concept suitable for modernizations of press sections which can be positioned in the place of an earlier press section even if, in the modernization, the machine speed and/or the dewatering capacity has/have been increased.

In view of achieving the objects stated above and others, in the press section in accordance with the invention, after a web transfer point from a press nip, an upper fabric of the last nip in the press section has a relatively short run after which the upper fabric is turned while being guided by a lower roll of the last nip over a considerable sector thereof The last nip is placed after, or at the vicinity of, the uppermost point of the lower roll that forms the last nip. The point of transfer of the web onto the drying wire of the first group in the dryer section following after the press section is placed underneath the level of the last nip.

In the invention, it has been possible to provide a novel press section concept by whose means good quality properties of the paper produced and reliable operation of the press section particularly at high speeds are achieved. An adequate dewatering capacity also at high running speeds has been guaranteed in the invention by employing at least one extended-nip press, the length of the press zone of this extended-nip press in the machine direction being generally larger than about 100 mm.

In the invention, an important aspect is the arrangement of the last nip by whose means an undisturbed transfer of the web, an adequate dewatering capacity, equalization of any differences in coarseness of the opposite faces of the web if necessary, and reliable transfer of the web onto the drying wire of the first cylinder group in the dryer section are guaranteed or at least substantially assisted. In connection with the preferably smooth-faced lower roll of relatively large diameter, only one press nip is arranged as a result of which the construction can have a low height also in respect of the circulation of the upper fabric in the last nip. Furthermore, an advantageous removal of broke by the force of gravity after the first extended nip can also be carried into effect.

When a press section in accordance with the present invention is applied to thin printing and writing papers, the first extended nip proper can be substituted for by an extended roll nip, in which the nip length can be increased to the necessary length by using a roll diameter larger than normal in the press rolls, which roll diameter is, in such a case, selected typically in the range of about 1000 mm to about 2000 mm. If necessary, the construction can also be carried out with roll diameters smaller than those mentioned above.

In the following, the invention will be described in detail with reference to some exemplifying embodiments of the invention illustrated in the figures in the accompanying drawing. However, the invention is by no means strictly confined to the details of these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE DRAWINGS

Figure 1:
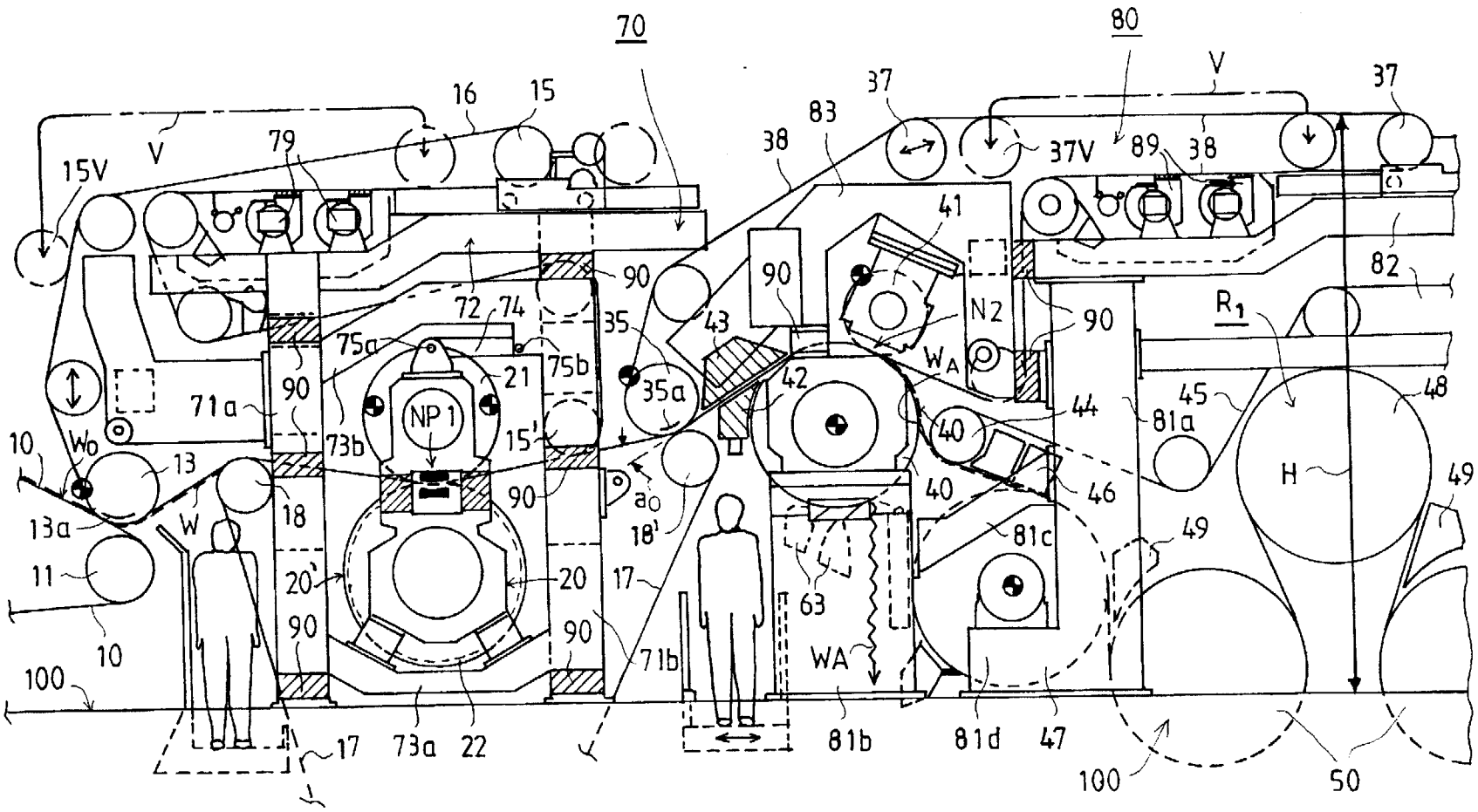
FIG. 1 shows a side view of a first embodiment of the invention with its frame constructions.

Referring to the accompanying drawings wherein the same reference numerals refer to the same or similar elements, the common features of the press sections shown in FIGS. 1–5 will be described in the illustrated press sections, a paper web $W_0$ is passed to the press section from a forming wire 10 on which the web is being carried at a location before the forming wire runs over a wire reversing roll 11, and specifically, the web is transferred from the forming wire 10 onto an upper press fabric 16 by means of the vacuum in a suction zone 13*a* of a pick-up roll 13. The upper press fabric 16 is guided by guide rolls 15 and 15' and carries the paper web W on its lower face into a first press nip which is expressly an extended nip $NP_1$. The web W runs through the press zone of the extended nip $NP_1$ sandwiched between two press fabrics 16 and 17 that receive water. The upper fabric is the pick-up fabric 16 mentioned above, and the lower fabric is the fabric 17 which receives water and is guided by guide rolls 18,18' to carry the web W further after the extended nip $NP_1$ while the upper fabric 16 is separated from the web W in or before the area of the guide roll 15'.

The first extended nip $NP_1$ operates to remove water efficiently and from two sides of the web and is formed between a lower hose roll 20 and an upper solid-mantle press roll 21. In the lower hose roll 20, there is a flexible hose mantle 20'. The hose roll 20 may be, for example, similar to that illustrated in FIG. 10 in the assignee's Finnish patent application Ser. No. 905798 referenced above. Inside the flexible mantle 20' of the hose roll 20, there are press-glide shoes 22 which are explained in greater detail therein and by whose means, compression pressure is produced in the nip zone. A rigid mantle 21' of the upper roll 21 in the extended nip $NP_1$ may have a smooth outer face or a hollow face without through perforations. The first extended nip $NP_1$ can also be constructed so that the upper roll 21 is a hose roll and the lower roll 20 a smooth-faced/hollow-faced rigid press roll. The lower roll 20 may also be a suction roll if a relatively low press load is employed in the extended nip $NP_1$. In such a case, the use of a suction roll is also advantageous in the respect that it helps the web W to follow the lower felt 17.

The length of the extended-nip zone of the extended nip $NP_1$ and of possible other extended nips, e.g., $NP_2$, if any, in the machine direction is typically larger than about 100 mm, preferably in the range of 150 mm to about 300 mm. In the extended-nip zone $NP_1$,$NP_2$, the compression pressure can be arranged so that it can be profiled both in the machine direction and in the cross direction so as to obtain an optimal pressing result. The upper press roll 21 can be provided with inside crown-variation means 23 (FIG. 2), so that the compression pressure in the extended nip $NP_1$ can be profiled at least gently. As stated above, the first extended nip $NP_1$ removes water efficiently, for example, so that, while the dry solids content $k_0$ of the web $W_0$ is from about 12% to about 25% before the extended nip $NP_1$, the dry solids content $k_1$ after the extended nip $NP_1$ is from about 25% to about 50%.

In the following, the frame construction of the press section, which has been sketched in FIG. 1, will be described briefly. The frame construction of the press comprises a front frame 70 and a rear frame 80 which are supported on a floor construction 100 of the paper machine hall. The front frame 70 comprises vertical parts 71*a* and 71*b* between which the bearing supports of the rolls 20 and 21 of the first extended nip $NP_1$ are supported by means of horizontal frames 73*a* and 73*b*. The first extended nip $NP_1$ is arranged to be openable by supporting the bearing supports of the upper roll 21 on the horizontal part 73*b* of the frame by means of intermediate arms 74 provided with horizontal articulated joints 75*a* and 75*b*. The rear frame 80 comprises vertical parts 81*a*,81*b*, horizontal parts 82, and a projection part 83 attached to the vertical part 81*a*. The lower roll 40 of the second nip $N_2$ is stationarily mounted on the vertical part 81*b*. Between the frame parts 81*b* and 81*a*, there is a horizontal part 81*c*, and the first drying cylinder 47 is mounted on a frame part 81*d*. In the front frame and the rear frame 70 and 80, at the driving side of the machine, there are openable intermediate pieces 90, after whose opening the fabrics 16, 17 and 38 can be replaced in a way in itself known. Between the front frame and the rear frame 70 and 80, it is possible to arrange a free space that is open upwards, through which space the press rolls and the other components can be replaced, if necessary, by lifting straight upward. For replacement of the upper fabrics 16 and 38, the guide rolls 15 and 37 can be shifted to the inner positions 15 V and 37 V in the directions of the arrows V.

Figure 3:
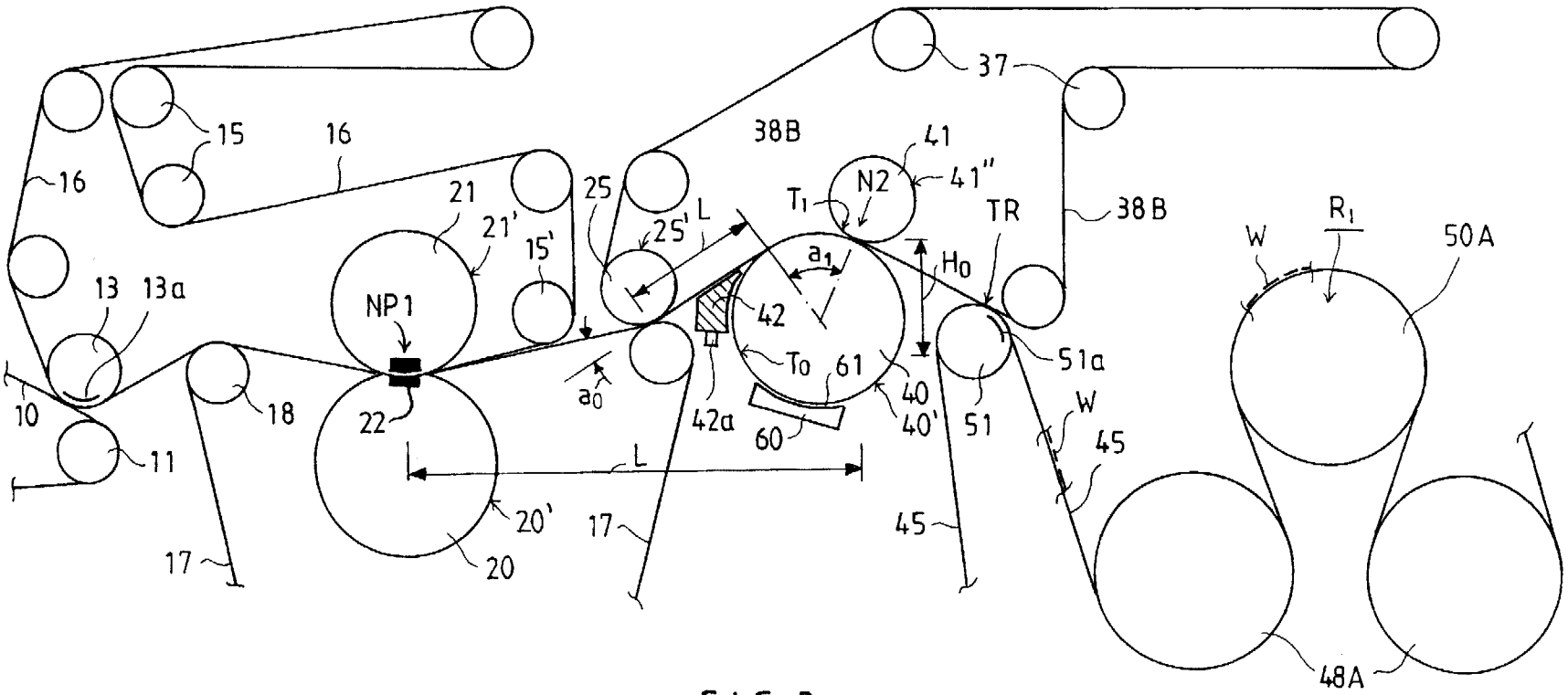
FIG. 3 shows a third embodiment of the invention without frame constructions, which embodiment differs from the first embodiment as shown in FIG. 1 in respect of the transfer of the web after the second roll nip.
Figure 4:
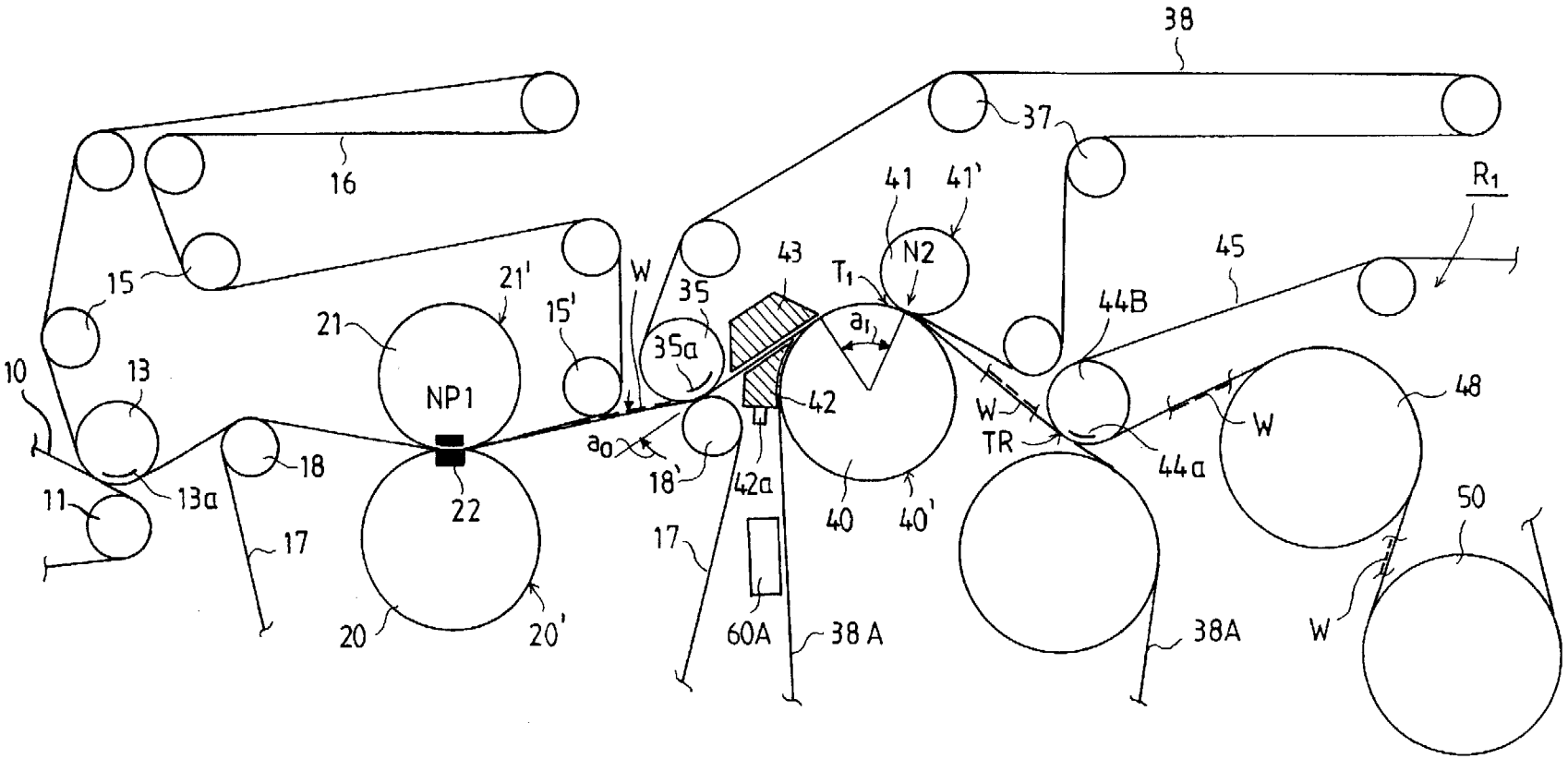
FIG. 4 shows such a fourth embodiment of the invention, without frame constructions, in which a transfer band that runs around the lower roll in the second roll nip is employed, by means of which transfer band the web is transferred as a closed draw onto the drying wire of the dryer section.

Referring now primarily to FIGS. 1, 3 and 4, in the press sections shown in these drawings, after the first extended nip $NP_1$, the second press nip is a sharp roll nip $N_2$. The second roll nip $N_2$ is placed at a slightly higher level than the first extended nip $NP_1$ so that the difference in height $H_0$ (FIG. 3) is typically from about 500 mm to about 2000 mm. In the exemplifying embodiment as shown in FIG. 1, the overall height H of the press section can be made relatively small, and the height H above the machine plane is typically in a range of from about 5 m to about 12 m, and preferably from about 6 m to about 9 m. Thus, a relatively low construction is provided, because the cycles of the upper fabrics 16 and 38 can also be made low and simple. The horizontal distance L between the nips $NP_1$ and $N_2$ in the machine direction is typically dimensioned in a range of from about 5 m to about 12 m.

As shown in FIGS. 1, 3 and 4, the web W is transferred from the upper face of the lower fabric 17 of the first extended nip $NP_1$ onto a lower face of a second upper fabric 38,38B of the second roll nip $N_2$ by means of a transfer-suction roll 35 or by means of a reversing roll 25 (FIG. 3) which has a smooth mantle 25'. In the transfer of the web W from the lower fabric 17 to the upper fabric 38,38B, an angle $a_0$ defines the change in direction which is as small as possible and less than about 45°, preferably only about 30°. In FIGS. 1 and 4, the upper fabric 38 is a press fabric that receives water, in which case a suction-roll transfer is employed and the transfer-suction roll 35 includes a suction zone 35*a*. In FIG. 3, the upper fabric 38B is a substantially impervious transfer band 38B that does substantially not receive water, in which case the transfer roll 25 is not a suction roll, but the transfer from the fabric 17 to the fabric 38B takes place based on the adhesion properties of the outer face of the transfer band 38B. After the transfer point, there is a short upward inclined straight run of the upper fabric 38,38B carrying the web thereon, without an additional fabric engaging with the lower face of the web. The length $L_0$ of this upward run (FIG. 3) is typically from about 400 mm to about 2000 mm, and preferably from about 700 mm to about 1400 mm. On this run of the fabric 38,38B, outside the fabric loop, a steam box 42 is arranged to act against the free lower face of the web W. Steam box 42 is provided with a duct 42*a* for the supply of hot steam.

In the press section shown in FIG. 3, the last nip $N_2$ is particularly well suitable for use as an equalizing press nip, by whose means an asymmetry of coarseness of the opposite sides of the web W to be pressed, which asymmetry arose in the first extended nip $NP_1$, is equalized. In such a case, the surface properties of the transfer fabric 38B are selected so that they are suitable for the equalizing-press function.

Figure 5:
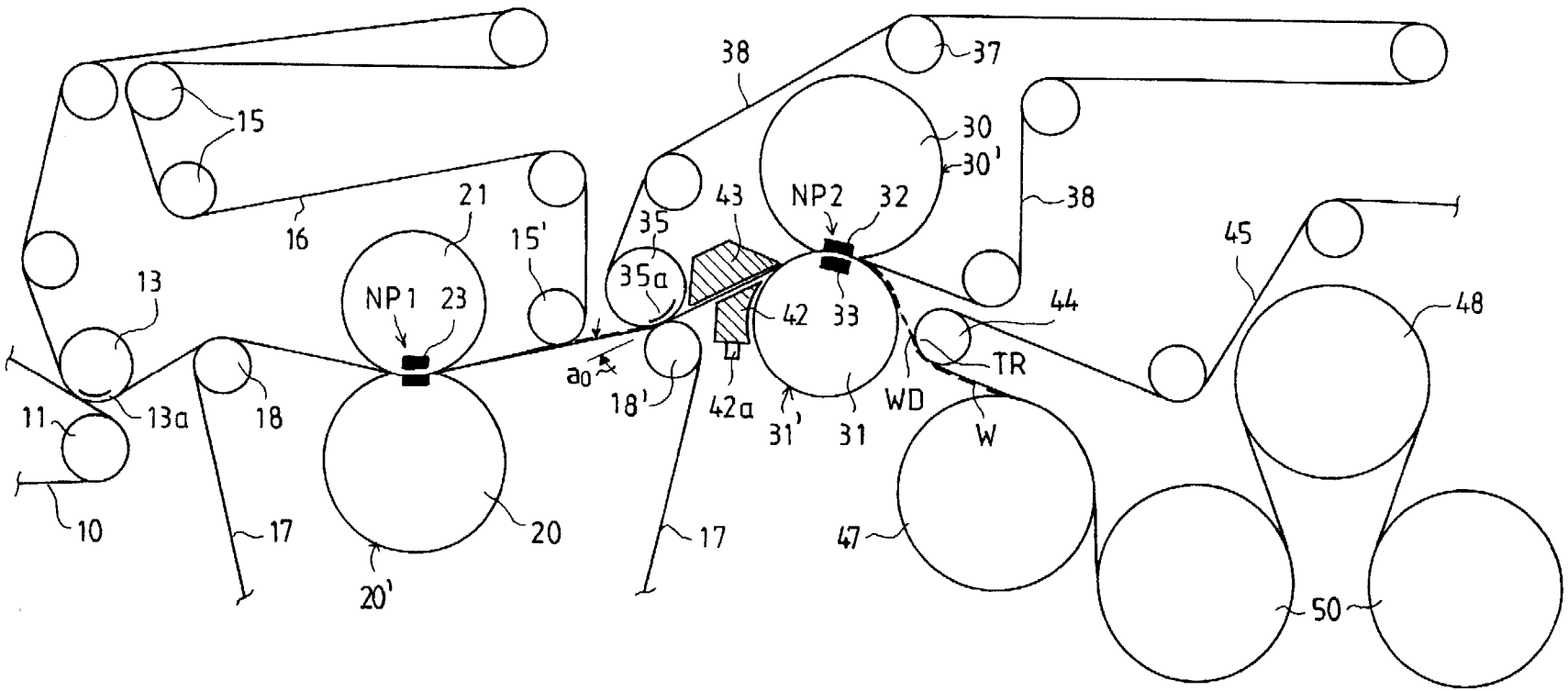
FIG. 5 shows an embodiment of the invention which is in particular suitable for thicker grades and in which an extended nip is also employed as the last nip.

According to FIGS. 1 and 4, a suction box 43 is arranged opposite to the steam box 42 and inside the fabric loop 38. Suction box 43 is preferably a suction box based on air blowings, e.g., as marketed by the assignee under the trade mark PRESS-RUN™, which suction box is not employed in the embodiment shown in FIG. 3. The heating effect applied to the free outer face of the web W by the steam box 42 is intensified by the suction box 43. In FIGS. 1–4, after the straight run $L_0$ of the fabric 38,38B, there is a turning sector $a_1$ of a lower roll 40 having a smooth-face 42 (of the second nip $N_2$), before the sharp roll-nip zone $N_2$. The turning sector $a_1$ is selected in a range of from about 45° to about 130°, preferably in a range from about 60° to about 100°. The roll nip $N_2$ is formed between the lower roll 40 and an upper roll 41 having a hollow-face 41',41". In FIG. 3, the face 41" of the upper roll 41 may be smooth. A heating device 60 is arranged in connection with the smooth face 40' of the lower roll 40 of the roll nip $N_2$ to define a treatment gap 61 therebetween in which a heating effect is applied to the roll face 40', e.g., by means of infrared radiation, a magnetic induction effect, and/or by means of hot steam. In this manner, the temperature of the roll face is raised to the level $T_0$ of about 60° C. to about 150°C., and on the sector $a_1$, the thermal energy is transferred from the roll face 40' to the web W so that, owing to the heating effect jointly with the steam box 42, the temperature level $T_1$ of the web W before the nip $N_3$ is raised considerably. Typically, this temperature level $T_1$ is in a range of from about 60° C. to about 110°C. Owing to a sufficiently long turning sector $a_1$, an efficient transfer of heat from the heated roll face 40' to the web W is achieved. Owing to the raised temperature level $T_1$ of the web W, the dewatering is intensified in the nip $N_2$,$NP_2$ (FIG. 5). The last nip $N_2$,$NP_2$,$N_3$ is placed after the uppermost point of the lower roll 40 on the first upper quarter of the roll 40. After the last nip $N_2$,$NP_2$,$N_3$, the web W has a downwardly inclined run after which the web W is transferred onto a drying wire 45 of the dryer section.

In accordance with the invention, in the arrangement of the last nip $N_2$,$NP_2$,$N_3$, and more particularly in connection with the large-diameter lower roll 40, only a single nip is arranged, this single nip being the last nip in the press section. This last nip is placed slightly after the uppermost point of the lower roll 40. The "large-diameter" lower roll 40 connotes a roll having a diameter from about 1000 mm to about 1700 mm.

According to FIG. 1, after the second nip $N_2$, the web W is transferred on the smooth face 40' of the lower roll 40, at the transfer-suction roll 44, as a short free draw WD onto the drying wire 45, to which the web W is made to adhere by means of suction boxes 46. On the drying wire 45, the web W is transferred onto a first drying cylinder 47 in the dryer section which is placed at a level lower than the normal or standard position of the upper cylinders in the first group $R_1$. In the dryer section, after this first drying cylinder 47, there are reversing suction cylinders 50, for example the assignee's VAC™ rolls. Further, in FIG. 1, the first contact-drying cylinder 48 placed at the normal level and blow-suction boxes 49, such as the assignee's UNO RUN BLOW BOXES™, are shown.

In FIG. 3, after the second roll nip $N_2$, the web W follows the upper transfer band 38B and is carried on support thereof in a straight downwardly inclined run to a transfer point TR whereat the web W is transferred by means of a suction zone 51*a* of a transfer-suction roll 51 onto the face of the drying wire 45 of the cylinder group $R_1$. In FIG. 3, the first cylinder group $R_1$ is an inverted group in which heated contact-drying cylinders 48A are placed in a lower row and reversing suction cylinders 50A are placed in an upper row above the row of contact-drying cylinders.

In FIG. 4, a transfer band 38A that runs over the lower cylinder 40 of the roll nip $N_2$ is employed. The web W is transferred on the upper face of the downwardly inclined straight run of the band 38A after the second roll nip $N_2$ onto the drying wire 45 of the first cylinder group $R_1$ at the transfer point TR by means of the vacuum present in the suction zone 44*a* of the transfer-suction roll 44B. After the transfer point TR, the transfer band 38A is guided by the roll 47A. When a transfer band 38A is used, it is not always favorable to use a roll 40 heating device 60 as shown in FIG. 3, but, if necessary, the heating effect can be applied directly to the band 38A, which is heating effect is illustrated schematically by a heating device 60A.

Figure 2:
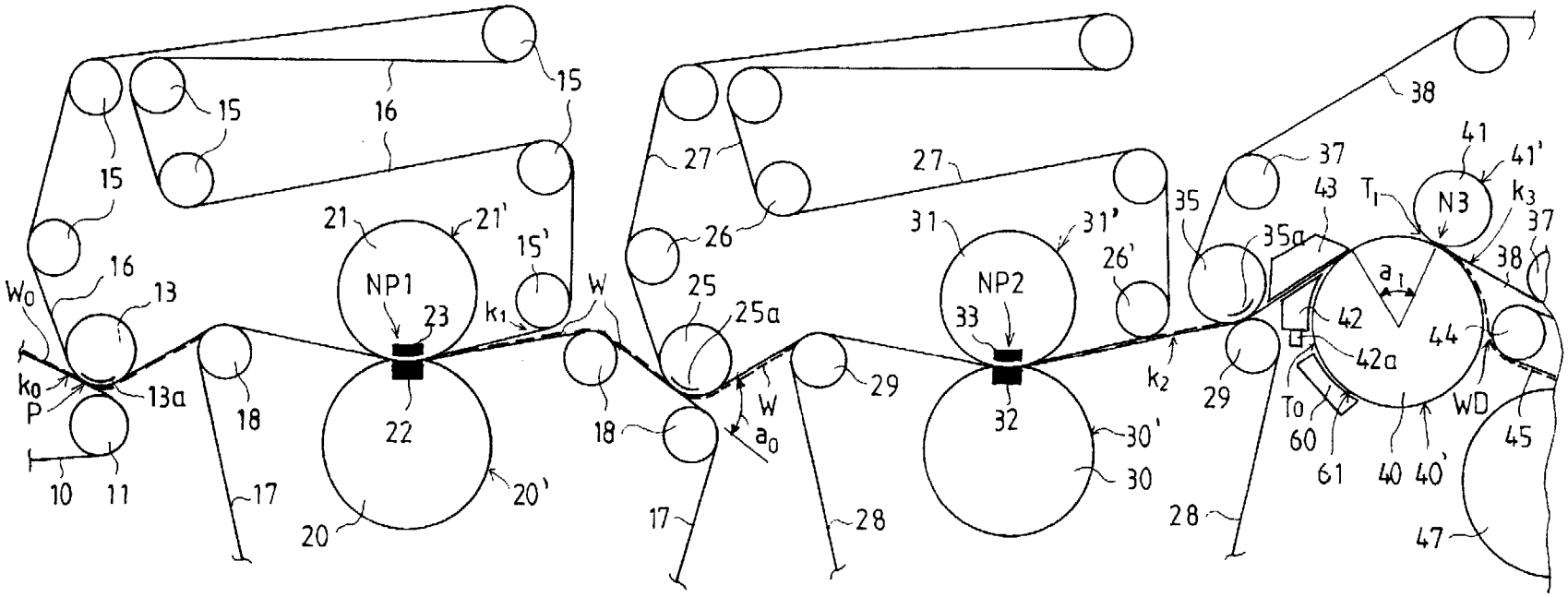
FIG. 2 shows a second embodiment of the invention, in which two successive extended nips are employed, the frame constructions not being shown.

FIG. 2 shows an embodiment of the invention in which, after the pick-up point P of the web W, two successive extended nips $NP_1$ and $NP_2$ are employed. The first extended nip $NP_1$ is similar to that described above in relation to the embodiments illustrated in FIGS. 1, 3 and 4. After the reversing roll 15' of the first upper fabric 16 that receives water, the web W follows the lower fabric 17 that receives water, on whose downwardly inclined run between the guide rolls 18 the web W is transferred onto the second upper fabric 27 which is guided by guide rolls 26 on the suction zone 25*a* of the transfer-suction roll 25. On this sector, the direction of the web W is changed over a small angle $a_0$. On the upper face of the second upper fabric 27 that receives water, the web W is passed into the second extended nip $NP_2$, in which there is a lower extended-nip roll 30 provided with a hose mantle 30' and an upper rigid press roll 31 which has a smooth-faced or hollow-faced mantle 31'. In the rolls 30 and 31, there are press-glide shoes 32 and 33 corresponding to the shoes 22 and 23 in the first nip $NP_1$.

The embodiment as shown in FIG. 2 is particularly well suitable for producing thicker paper grades whose grammages are typically in a range of from about 60 g/m$^2$ to about 300 g/m$^2$. In such a case, the dry solids content $k_1$ of the web W after the first extended nip $NP_1$ is typically from about 30% to about 50%, and the dry solids content $k_2$ of the web after the second extended nip $NP_2$ is typically from about 45% to about 55%. After the second upper fabric 27, the web W is transferred on the lower fabric 28 that receives water of the second extended nip $NP_2$, to be transferred on the suction zone 35*a* of the transfer-suction roll 35 onto the upper fabric 38 of a third roll nip $N_3$. The arrangement of the third roll nip $N_3$ with its various devices is similar to the arrangement of the corresponding second roll nip $N_2$ shown in FIG. 1. In FIG. 2, the upper fabric 38 of the last roll nip $N_3$ can be substituted for by a transfer band 38B as shown in FIG. 3, in which case the last nip $N_3$ is particularly well suitable for use as an equalizing press nip by whose means it is possible to equalize the asymmetry of coarseness of the opposite faces of the web W that arose in the preceding extended nips $NP_1$, and $NP_2$.

FIG. 5 shows an embodiment of the invention in which the second roll nip $N_2$ as shown in FIG. 1 has been substituted for by a corresponding extended nip $NP_2$. The second extended nip $NP_2$ is formed by an upper extended-nip roll provided with a flexible hose mantle 30', and the lower press roll is a smooth-faced 31' rigid press roll 31 which is provided with crown-variation means for crown variation, such as internal glide shoes 33. After the extended-nip zone $NP_2$, the web W follows the smooth face 31' of the lower roll 31 from which the web W is separated as a short free draw WD and transferred onto the drying wire 45 of the first cylinder group $R_1$ in the dryer section.

The arrangement in accordance with the present invention of the second nip $N_2$,$NP_1$ or of the third nip $N_3$ is also advantageous in view of the fact that the smooth-faced 40',31' lower roll 40,31 of the nip concerned can be doctored readily, and even more so, because there is an adequate space available for suitable doctor devices in the arrangement. In FIG. 1, doctors 63 are shown, from which there is a straight and direct connection to the pulper (not shown) placed underneath the doctors, the broke web passing into the pulper being denoted with the reference WA in FIG. 1.

Figure 6:
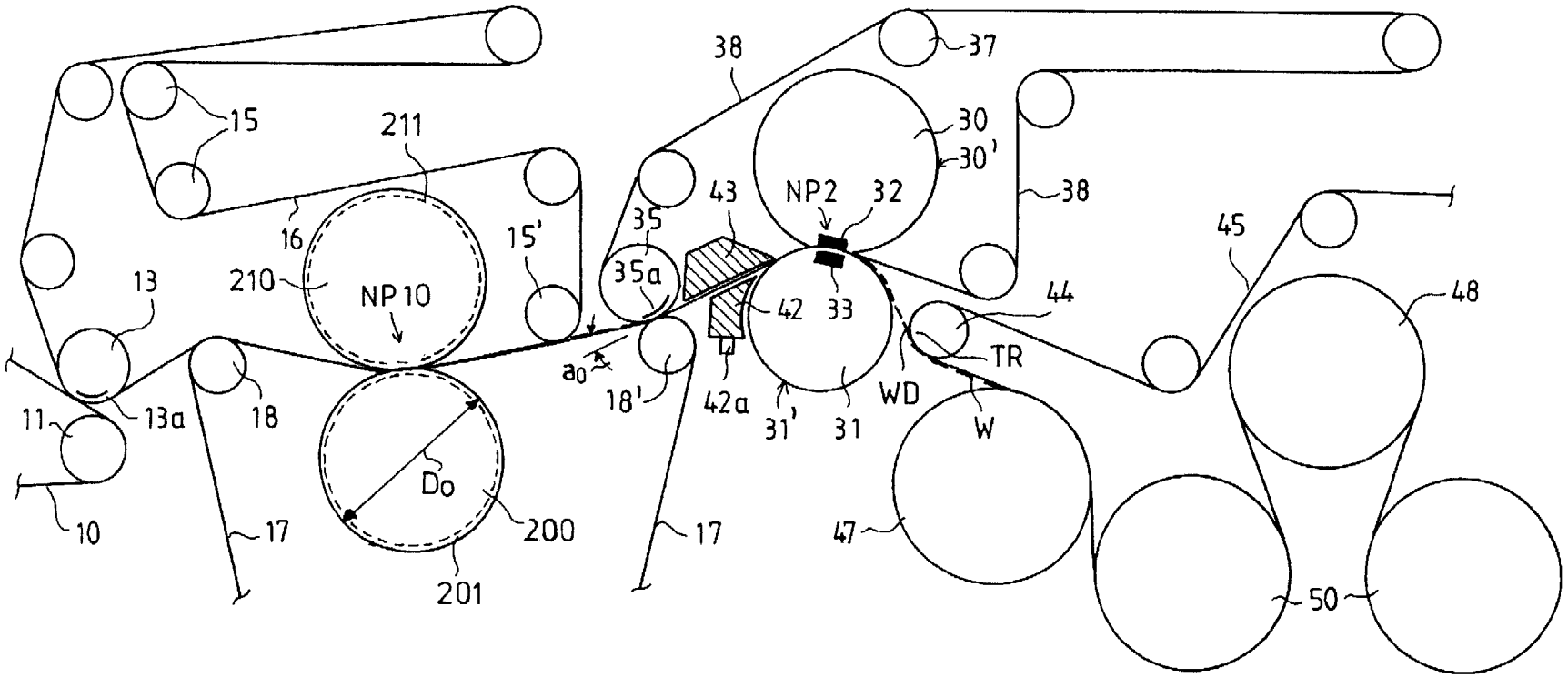
FIG. 6 shows such a modification of the press section as shown in FIG. 5 in which the first nip is an extended roll nip.
Figure 7:
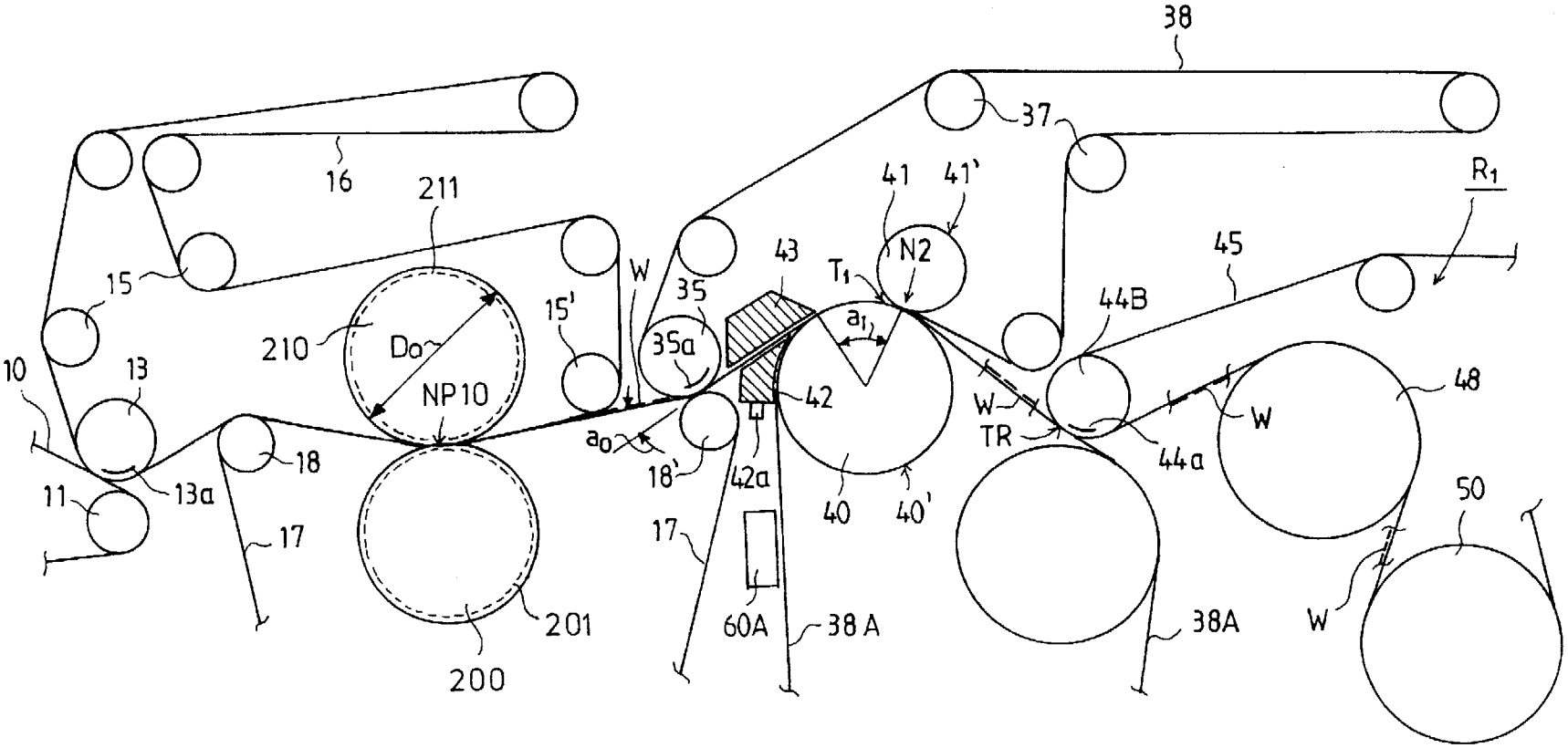
FIG. 7 shows such a modification of the press section as shown in FIG. 4 in which an extended roll nip has been used in stead of the first extended nip proper.

FIGS. 6 and 7 show an embodiment of the invention in which, as the first nip $NP_{10}$, instead of an extended nip $NP_1$ proper, an extended roll nip is applied. The press section shown in FIG. 6 is in the other respects similar to that shown in FIG. 5, and the press section shown in FIG. 7 is in the other respects similar to that shown in FIG. 4

In the embodiment shown in FIG. 6, the first extended roll nip $NP_{10}$ is provided with two press fabrics 16 and 17 and formed between an upper press roll 210 and a lower press roll 200. Both of the press rolls 200 and 210 are provided with a hollow face 201,211, respectively, which hollow face is produced by means of grooves and/or blind-drilled bores. The first extended roll nip $NP_{10}$ in FIG. 7 is formed in a corresponding manner. The extending of the roll nip $NP_{10}$ is accomplished by using a press-roll 200,210 having a diameter $D_0$ which is larger than normal or standard. Generally, a sufficient extension of the roll nip $NP_{10}$ is obtained with roll diameters of from about 1000 mm to about 2000 mm. Within the scope of the present invention, it is not necessary to use a roll diameter $D_0$ larger than normal in the nip $NP_{10}$. In such a case in which a normal-diameter roll is used, the extending of the roll nip $NP_{10}$, if it is necessary, can be accomplished by choosing press fabrics 16 and/or 17 to be thicker than normal. The press section shown in FIGS. 6 and 7 is particularly well suitable for use with thin printing and writing papers. An advantage of the (extended) roll nip $NP_0$ in comparison with an extended nip proper and with hose rolls is the substantially lower cost of the construction.

Typical and preferred exemplifying embodiments of the linear loads in the various nips in the press section in accordance with the present invention, but nevertheless not confining the invention to these embodiments, are as follows:

First extended nip ($NP_1$)≈1200 kN/m, preferably about 1080 kN/m;

Second extended nip ($NP_2$ in FIG. 2)≈1200 kN/m, preferably about 1000 kN/m;

Second extended nip ($NP_2$ in FIG. 5)≈1200 kN/m, preferably about 1000 kN/m;

Second roll nip ($N_2$)≈200 kN/m, preferably about 150 kN/m;

Third roll nip ($N_3$)≈200 kN/m, preferably about 150 kN/m.

In the extended nips $NP_1$,$NP_2$ and in the extended roll nip $NP_{10}$, it is preferable to use press felts that are slightly heavier and thicker than normal, because in such press felts, the amount of water removed from the web is larger, and a high press impulse produces a marking of the fabric or of the hollow face in the paper more readily.

The hose mantle 20',30' of the extended-nip rolls 20,30 is preferably hollow-faced, such as grooved, blind-drilled or provided with other recesses.

According to the invention, a particularly compact press section is obtained so that, for example, in modernizations of paper machines in which the dewatering capacity of the press section is increased because of increased running speed of the paper machine, the press section can be placed in the place of an existing three-nip or four-nip press section that comprises exclusively roll nips, e.g., in the place of the assignee's SYM-PRESS II™ press.

A number of different variations of the details described above are possible within the scope of the present invention. For example, the heating means 60 for heating the lower roll 40 in the last nip $N_2$,$NP_2$,$N_3$ can also be arranged inside the roll, for example, by using hot water steam fed from the roll axles as a heating medium in a technique similar to a drying cylinder. Also, if necessary, the temperature of the roll 40 face 40' can be arranged so that it can be profiled in the axial direction of the roll 40, i.e., in the cross direction of the web W, in view of controlling the different property profiles of the web W. As a possible coating on the roll 40,31, it is possible to use the assignee's VALROK™ or DYNAROK™ coating or equivalent.

The general geometry of the press section is preferably arranged such that the level of the first extended nip $NP_1$ is placed substantially at the same level as the level at which the web W is transferred at the transfer point TR or as a free draw WD onto the drying wire 45. The last nip $N_2$,$NP_2$,$N_3$ is placed at a level higher than this level, with the difference in height ($H_0$) being from about 500 mm to about 2000 mm. In view of securing an optimal utilization of space and the removal of broke as well as the transfer of the web W, it is preferable that the last nip $N_2$,$NP_2$,$N_3$ is placed after the uppermost point of the lower roll 40,31 or, at the maximum, at the vicinity of the uppermost point, in which case the transfer of the web W from the last nip onto the drying wire 45 takes place so that its substantial direction is a gentle downwardly inclined run.

The examples provided above are not meant to be exclusive. Many other variations of the present invention would be obvious to those skilled in the art, and are contemplated to be within the scope of the appended claims.

We claim:

1. A press section of a paper machine arranged before a dryer section of the paper machine in which a drying wire runs, comprising at least a last press nip immediately preceding the dryer section and a preceding press nip immediately preceding said last press nip, said last press nip being arranged at a horizontal level higher than the horizontal level at which said preceding press nip is arranged, said last press nip being defined in part by a lower roll, a pair of water-receiving press fabrics for carrying a web therebetween through said preceding press nip, an upper press fabric for receiving the web from one of said pair of water-receiving press fabrics and for carrying the web through said last press nip, said upper press fabric having an upwardly inclined run after it receives the web from said one of said pair of water-receiving fabrics and thereafter a turning sector run over said lower roll of said last press nip in which the web is pressed by said upper press fabric toward said lower roll, the magnitude of said turning sector run of said upper press fabric, over said lower roll being from about 45° to about 130°, said last press nip being arranged at the vicinity of or after an uppermost point of said lower roll and after said turning sector run of said upper press fabric, transfer means for transferring the web to the drying wire at a transfer point arranged at a horizontal level lower than the horizontal level of said last press nip, the horizontal level at which said extended nip is arranged and the horizontal level of a point of transfer of the web by said transfer means onto the drying wire being substantially the same, said last press nip being arranged at a distance above the horizontal level at which said extended nip is arranged and the horizontal level of a point of transfer of the web by said transfer means onto the driving wire, the distance in height being from about 500 mm to about 2000 mm, and an additional press nip arranged prior to said preceding press nip in a direction of web travel, said additional and preceding press nips being extended nips and said last press nip being a sharp roll nip.

2. The press section of claim 1, wherein at a transfer point of the web from said one of said pair of water-receiving fabrics to said upper press fabric, the angular change in the direction of travel of the web is about 35°, and the magnitude of said turning sector run of said upper fabric on said lower roll is from about 60° to about 100°.

3. The press section of claim 1, wherein the upwardly inclined run of said upper press fabric is substantially straight, the length of the upwardly inclined substantially straight run of said upper press fabric being from about 400 mm to about 2000 mm and the overall height of the press section above a machine plane being dimensioned in the range of from about 5 m to about 12 m.

4. The press section of claim 1, wherein said upper press fabric is structured and arranged such that the web is carried only on said upper press fabric in said upwardly inclined run thereof while a lower face of the web is exposed, further comprising heating means for heating the exposed lower face of the web in said upwardly inclined run prior to said last press nip.

5. The press section of claim 4, wherein said heating means comprise a steam box for directing steam at said lower face.

6. The press section of claim 1, wherein said preceding press nip which is an extended nip is formed by a pair of rolls each having a diameter in the range from about 1000 mm to about 2000 mm.

7. The press section of claim 1, wherein the upwardly inclined run of said upper press fabric is substantially straight, the length of the upwardly inclined substantially straight run of said upper press fabric being from about 700 mm to about 1400 mm and the overall height of the press section above a machine plane being dimensioned in the range of from about 6 m to about 9 m.

8. The press section of claim 1, further comprising heating means for heating a mantle of said lower roll of said last press nip to raise the temperature of a roll face of said mantle such that on said turning sector run, the temperature level of the web is raised.

9. The press section of claim 1, further comprising suction means arranged in a loop of said upper fabric in the vicinity of the upwardly inclined run thereof for applying suction toward the web in said upwardly inclined run of said upper fabric.

10. The press section of claim 1, wherein at a transfer point of the web from said one of said pair of water-receiving fabrics to said upper fabric, the angular change in the direction of travel of the web is less than about 45°.

* * * * *